US005986250A

United States Patent [19]

Kang et al.

[11] Patent Number: 5,986,250

[45] Date of Patent: Nov. 16, 1999

[54] STRUCTURE FOR MOUNTING MAGNETRON FOR MICROWAVE OVEN

[75] Inventors: Jong-Soo Kang; Dong-Wan Seo, both of Changwon, Rep. of Korea

[73] Assignee: LG Electronics Inc., Rep. of Korea

[21] Appl. No.: 09/192,615

[22] Filed: Nov. 16, 1998

[30] Foreign Application Priority Data

Nov. 15, 1997 [KR] Rep. of Korea ..... 97-60243

[51] Int. Cl.[6] ..... H05B 6/80

[52] U.S. Cl. ..... 219/746; 219/756

[58] Field of Search ..... 219/756, 746, 219/748, 757, 749

[56] References Cited

U.S. PATENT DOCUMENTS 4,105,886 8/1978 Baron et al. ..... 219/749
4,351,998 9/1982 Keppel et al. ..... 219/746
4,431,889 2/1984 Saponara et al. ..... 219/749
4,733,037 3/1988 Nitta et al. ..... 219/746

FOREIGN PATENT DOCUMENTS 4-80527 3/1992 Japan ..... 219/756

*Primary Examiner*—Philip H. Leung
*Attorney, Agent, or Firm*—Ostrolenk, Faber, Gerb & Soffen, LLP

[57] ABSTRACT

A structure for mounting a magnetron for a microwave oven is disclosed. The structure includes a wave guide member engaged with a lower plate forming the bottom surface of a cooking chamber and guiding microwaves into the interior of the cooking chamber, and a magnetron mounted at one side of the wave guide member and providing microwaves into the interior of the wave guide member, whereby the microwaves are provided in the direction from the bottom surface of the cooking chamber to the interior of the cooking chamber, for thereby supplying the microwaves in the direction from the bottom surface of the cooking chamber into the interior of the cooking chamber.

3 Claims, 3 Drawing Sheets

STRUCTURE FOR MOUNTING MAGNETRON FOR MICROWAVE OVEN

BACKGROUND OF THE INVENTION

1. Field of the Invention

The present invention is directed to a microwave oven, and in particular to a structure for mounting a magnetron for a microwave oven which is capable of maximizing the capacity of a cooking chamber based on the entire size of a microwave oven and supplying microwaves in the direction from the bottom surface of the cooking chamber into the interior of the cooking chamber.

2. Description of the Conventional Art

The microwave oven is directed to generating microwaves using a magnetron for thereby cooking foods therein. FIGS. 1 and 2 illustrate the structure of a conventional microwave oven.

As shown therein, in the interior of a cavity 1, a cooking chamber 2 is formed, and a machinery compartment 3 is formed beside the cooking chamber 2.

Major elements are installed in the machinery compartment 3 for an operation of the microwave oven.

In detail, a wave guide member 4 is installed on a lateral surface of the cavity forming one wall of the cooking chamber 2, and a magnetron 5 is installed at a portion of the wave guide member 4.

In addition, a high voltage transformer 6 is installed below the magnetron 5, and a suction guide member 8 is formed beside a back plate 7 of the machinery compartment 3 for guiding an externally sucked air, and a fan 9 is installed beside the suction guide 8.

The fan 9 introduces air from the outside of the machinery compartment 3 into the interior of the machinery compartment 3.

In addition, an air duct 10 is installed on a lateral surface of the cavity 1 in the direction of the machinery compartment 3 for guiding the air from the interior of the machinery compartment 3 into the cooking chamber 2 through the magnetron 5 and the high voltage transformer 6.

In the thusly constituted conventional microwave oven, the magnetron 5 is installed at one side of the wave guide 4 installed on the lateral surface of the cavity 2 in the direction of the machinery compartment 3, so that the microwaves generated by the magnetron 5 are guided by the wave guide member 4 and then are supplied into the interior of the cooking chamber 2 from the lateral surface of the cooking chamber 2.

However, recently, as various types of microwave ovens are disclosed, it is impossible to meet various microwave oven design characteristics based on the conventional magnetron mounting structure in which the microwaves are supplied from only the lateral surfaces of the cooking chamber into the interior of the cooking chamber 2.

SUMMARY OF THE INVENTION

Accordingly, it is an object of the present invention to provide a structure for mounting a magnetron for a microwave oven which overcomes the aforementioned problems encountered in the conventional art.

It is another object of the present invention to provide a structure for mounting a magnetron for a microwave oven which is capable of maximizing the capacity of a cooking chamber based on the entire size of the microwave oven for thereby optimizing a design of the microwave oven.

It is another object of the present invention to provide a structure for mounting a magnetron for a microwave oven which is capable of supplying the microwaves in the direction from the bottom surface of the cooking chamber into the interior of the cooking chamber.

To achieve the above objects, there is provided a structure for mounting a magnetron for a microwave oven which includes a wave guide member engaged with a lower plate forming the bottom surface of a cooking chamber and guiding microwaves into the interior of the cooking chamber, and a magnetron mounted at one side of the wave guide member and providing microwaves into the interior of the wave guide member, whereby the microwaves are provided in the direction from the bottom surface of the cooking chamber to the interior of the cooking chamber.

Additional advantages, objects and features of the invention will become more apparent from the description which follows.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

The magnetron mounting structure for a microwave oven according to the present invention will be explained with reference to the accompanying drawings.

In the magnetron mounting structure for a microwave oven according to the present invention, a machinery compartment is formed below a cooking chamber formed inside a cavity of the microwave oven.

Figure 1:
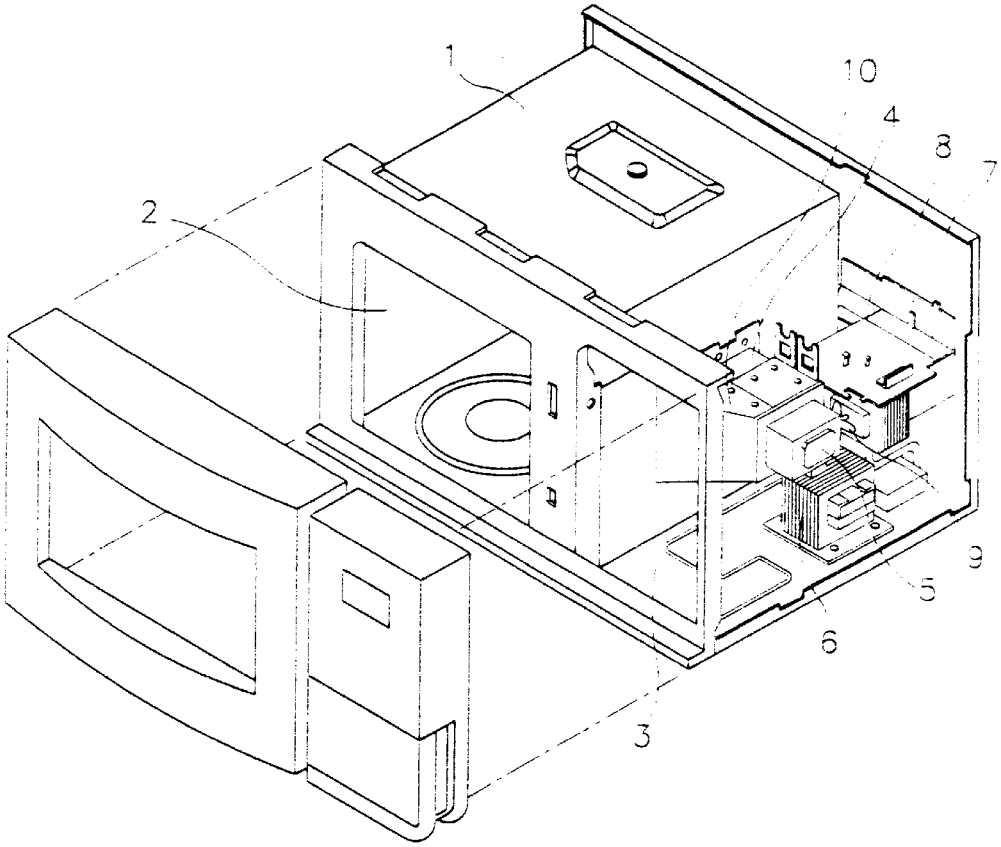
FIG. 1 BACKGROUND ART
FIG. 1 is a perspective view illustrating an inner structure of a conventional microwave oven.
Figure 2:
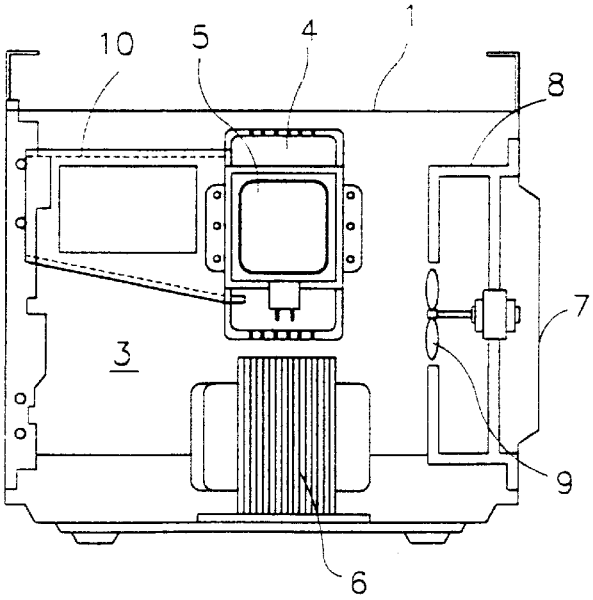
FIG. 2 BACKGROUND ART
FIG. 2 is a side view illustrating a state that a magnetron is mounted in a conventional microwave oven.
Figure 3:
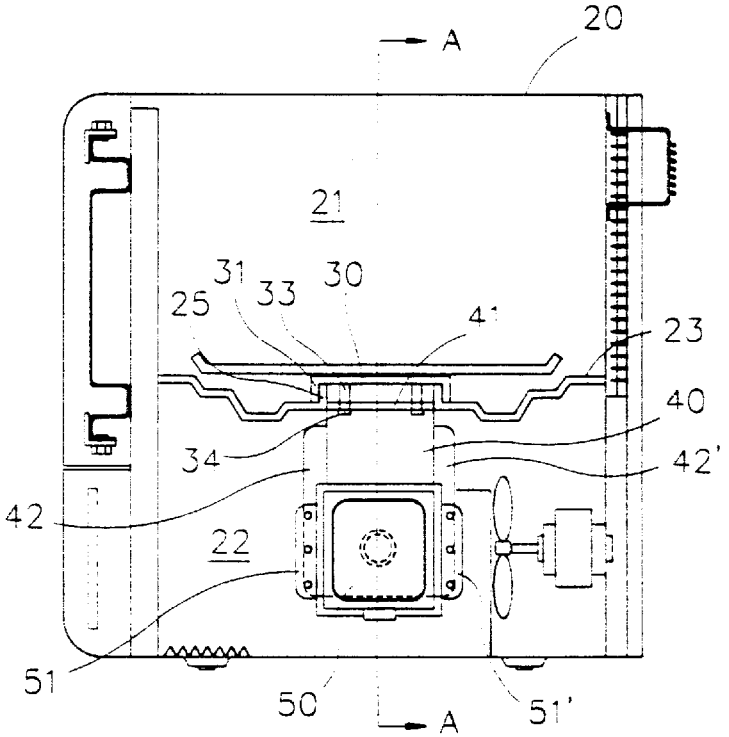
FIG. 3 is a side view illustrating a magnetron mounting structure for a microwave oven according to the present invention.
Figure 4:
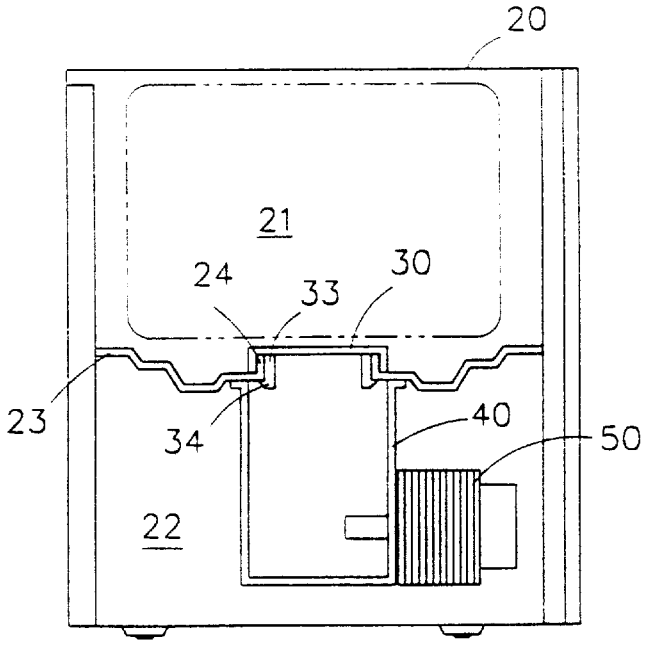
FIG. 4 is a cross-sectional view taken along the line A—A of FIG. 3 for illustrating a magnetron mounting structure for a microwave oven according to the present invention.
Figure 5:
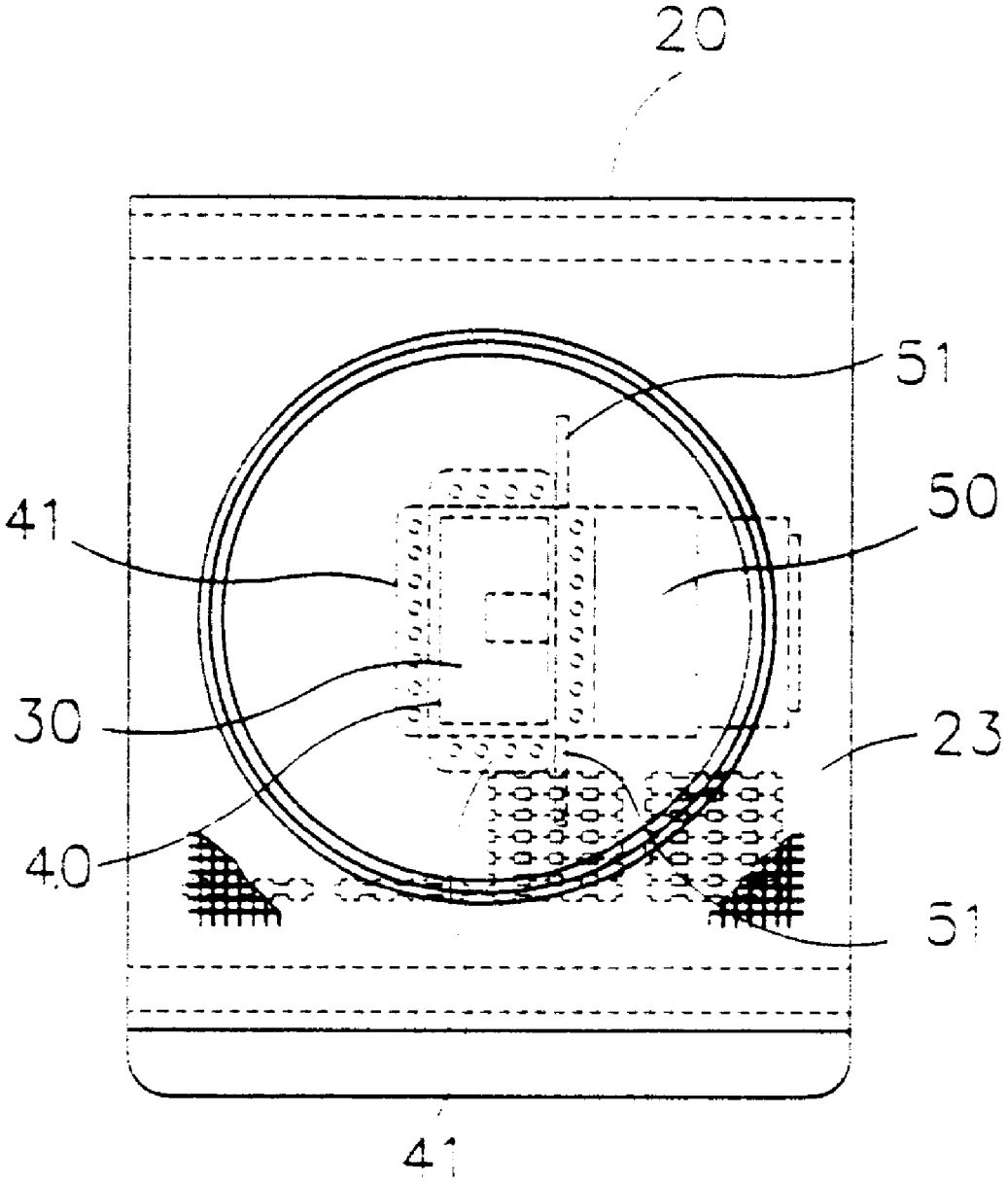
FIG. 5 is a plan view illustrating a magnetron mounting structure for a microwave oven according to the present invention.

FIG. 3 illustrates a magnetron mounting structure for a microwave oven according to the present invention, FIG. 4 is a cross-sectional view taken along the line A—A of FIG. 3 for illustrating a magnetron mounting structure for a microwave oven according to the present invention, and FIG. 5 illustrates a magnetron mounting structure for a microwave oven according to the present invention.

As shown therein, in the magnetron mounting structure for a microwave oven according to the present invention, a wave guide member 40 is formed on a bottom surface of a lower plate 23 forming a bottom surface of the cooking chamber 21.

At this time, a first engaging plate 41 formed at an upper portion of the wave guide member 40 is engaged on the lower surface of the lower plate 23 for thereby engaging the wave guide member 40 and the lower plate 23.

The wave guide member 40 guides microwaves generated by the magnetron 50 into the cooking chamber 21.

In addition, a wave guide cap 30 is installed at the upper portion of the wave guide 40, and a skirt portion 31 is formed at an outer edge portion of the wave guide cap 30.

The skirt unit 31 closely covers a support rib 25 formed on an edge portion of a wave hole 24 formed on the lower plate 23.

A plurality of engaging legs 33 are formed on the lower surface of the wave guide cap 30, and an engaging shoulder portion 34, as shown in FIG. 4, is formed at an end portion of the engaging leg 33.

Since the engaging shoulder portion 34 is engaged with an inner portion of a first engaging plate 41 of the wave guide member 40 or a lower portion of the lower plate 23 for thereby engaging the wave guide cap 30 with the wave guide member 40.

Namely, the wave guide cap 30 capping the upper portion of the wave guide member 40 is formed on the bottom surface of the cooking chamber 2 and is engaged with the wave guide member 40 formed on the bottom surface of the lower plate 23.

Therefore, the wave guide cap 30 supports the wave guide member 40.

A magnetron 50 is mounted at one side wall of the wave guide member 40.

The magnetron 50 generates microwaves, and the thusly generated microwaves are transferred into the interior of the wave guide member 40.

The magnetron 50 is mounted at one side of the wave guide member 40 in such a manner that the engaging plates 51 and 51' of the magnetron 50 are engaged with the upwardly and downwardly extended second engaging plates 42 and 42'.

The operation that the microwaves are transferred into the interior of the cooking chamber 21 of the microwave oven will be explained.

First, the microwaves generated by the magnetron 50 are transferred into the interior of the wave guide member 40.

The microwaves transferred into the interior of the wave guide member 40 are guided toward the upper portion of the wave guide member 40.

The microwaves transferred toward the upper portion of the wave guide member 40 are transferred from the bottom surface of the cooking chamber 21 into the interior of the cooking chamber 21 through the wave guide cap 30 for thereby cooking the foods in the cooking chamber 21.

The wave guide cap 30 is positioned on the upper surface of the lower plate 23 forming the bottom surface of the cooking chamber 21 and closes the upper portions of the wave guide member 40 and supports the wave guide member 40. Even when foods are over boiled and then are over flown beyond the rim of a food container, the thusly over-flown foods are not introduced into the interior of the wave guide member 40.

The thusly constituted magnetron mounting structure for a microwave oven according to the present invention is well applicable to a microwave oven in which the machinery compartment 22 is formed below the cooking chamber 21, and the plate forming the cooking chamber 21 forms the outer wall of the microwave oven.

As described above, in the magnetron mounting structure for a microwave oven according to the present invention, it is possible to supply microwaves in the direction from the lower portion of the cooking chamber to the cooking chamber for thereby minimizing the size of the microwave oven and increasing the capacity of the cooking chamber.

Although the preferred embodiments of the present invention have been disclosed for illustrative purposes, those skilled in the art will appreciate that various modifications, additions and substitutions are possible, without departing from the scope and spirit of the invention as recited in the accompanying claims.

What is claimed is:

1. A magnetron mounting structure for a microwave oven, comprising:

a cooking chamber;

a machinery chamber formed below the cooking chamber, and further comprising:

a lower plate formed between the cooking chamber and the machinery chamber;

a wave guide member engaged with a lower surface of the lower plate;

a wave guide cap formed on a bottom surface of the cooking chamber for closing an upper portion of the wave guide member, said wave guide cap being engaged with the wave guide member that is engaged with the lower surface of the lower plate;

a plurality of engaging legs formed on a lower surface of the wave guide cap and engaged with an inner surface of an engaging plate of the wave guide member; and a magnetron mounted at one side of the wave guide member for providing microwave energy into an interior of the wave guide member, whereby the microwave energy is directed from the bottom surface of the cooking chamber to an interior of the cooking chamber.

2. The structure of claim 1, wherein an engaging shoulder is formed at an end portion of each of the engaging legs, said engaging shoulders being engaged with the inner surface of the engaging plate of the wave guide member.

3. The structure of claim 1, including a skirt portion formed at a rim of the wave guide cap, said skirt portion being in contact with the upper surface of a support rid formed on the lower plate.

* * * * *